US007690054B1

(12) United States Patent
Pansini

(10) Patent No.: US 7,690,054 B1
(45) Date of Patent: Apr. 6, 2010

(54) WATER LEVEL CONTROL FOR VANISHING EDGE POOL

(76) Inventor: Andrew L. Pansini, 200 Golden Gate Ave., Belvedere, CA (US) 94920

( * ) Notice: Subject to any disclaimer, the term of this patent is extended or adjusted under 35 U.S.C. 154(b) by 562 days.

(21) Appl. No.: 11/700,310

(22) Filed: Jan. 31, 2007

(51) Int. Cl.
*E04H 4/00* (2006.01)

(52) U.S. Cl. ..... 4/508; 4/507

(58) Field of Classification Search ..... 4/507, 4/508

See application file for complete search history.

(56) References Cited

U.S. PATENT DOCUMENTS 1,536,054 A * 5/1925 Bartlett ..... 137/101.29
3,386,107 A * 6/1968 Whitten, Jr. ..... 4/508
3,996,954 A * 12/1976 Monnet ..... 137/116.3
4,133,058 A * 1/1979 Baker ..... 4/508
4,183,108 A * 1/1980 Hamilton ..... 4/354
4,498,984 A * 2/1985 Colson ..... 4/508
4,607,399 A * 8/1986 Yovanofski ..... 4/508
5,154,205 A * 10/1992 Langill ..... 4/508
5,301,375 A * 4/1994 Osmond ..... 4/368
5,655,232 A * 8/1997 Buckwalter ..... 4/508
6,012,481 A 1/2000 Lenart
7,003,817 B1 * 2/2006 Pansini ..... 4/508

* cited by examiner

*Primary Examiner*—Khoa D Huynh
(74) *Attorney, Agent, or Firm*—Howard Cohen

(57) ABSTRACT

An apparatus for automatically controlling the water level of a pool includes a first tank having a first water level, the first tank including a first float valve connected to a high pressure water source. A second tank has a second water level that is below the first water level, thereby defining a pressure head between the two tanks. The second tank includes a second float valve that is supplied by the pressure head between the two tanks, so that the second float valve receives low pressure water and is adapted to open and close within a range that spans a fraction of an inch. The second tank also includes an adjustable drain opening. The second tank water level varies between an upper limit set by the drain opening and a lower limit set by the opened position of the second float valve. The second tank is connected directly to the pool in open flow communication, so that the water level set in the second tank in turn sets the water level of the pool.

9 Claims, 3 Drawing Sheets

WATER LEVEL CONTROL FOR VANISHING EDGE POOL

CROSS-REFERENCE TO RELATED APPLICATIONS

Not Applicable

FEDERALLY SPONSORED RESEARCH

Not applicable.

SEQUENCE LISTING, ETC ON CD

Not applicable.

BACKGROUND OF THE INVENTION

1. Field of the Invention

This invention relates to an automatic fill water level control device and an overfill drain device for use with a swimming pool to obtain a desired pool water level. More specifically, the invention relates to a dual tank arrangement that is in communication with a pool and contains an adjustable automatic fill device and an overfill drain device in a fixed relationship to each other, so that setting the level of one of the devices automatically sets the level of the other device.

2. Description of Related Art

Conventional pools contain overfill drains constructed as follows. A drain pipe is placed in the pool wall at the height of the desired water level, which may be coincident with a scupper extending within the pool wall below the upper extent thereof. The drain pipe terminates either on the land surrounding the pool or into a nearby drain. Leaves and other debris floating on the pool water surface can plug the outlet hole in the pool wall, compromising the efficiency of the overfill drain and causing overflow conditions. A recent innovation in pool design is the vanishing edge pool, in which the water level is intended to coincide with the upper extent of the pool wall, and a drain channel is provided outside the pool wall and below the upper extent thereof. The pool water appears to be uncontained and thus creates an arresting visual presence. However, water level control is critical to achieving this effect without squandering a large volume of water flowing over the pool edge. The simple drain pipe of prior art pools cannot be used in a vanishing edge pool, due to the fact that there is no pool wall extending above the water level in which to mount the drain opening.

Thus, for a vanishing edge pool it is essential to maintain tight control on the water level of the pool; i.e., with ⅛ inch tolerance. In particular, the water fill level and the water drain level must be spaced vertically to a very close dimension to avoid unnecessary waste of water while keeping the water level coincident with the upper edge of the pool wall. One prior art apparatus, described in U.S. Pat. No. 7,003,817, provides an automatic fill device for a pool, and an overfill drain device, both supported on a common structure that is adjustable vertically. This arrangement enables adjustment of both the fill level and drain level in one operation, and prevents misalignment of those two levels that can cause overfill conditions or insufficient water levels.

The incoming water to the automatic fill device is typically provided at high pressure, either from city water mains or from a pump (well pump, pool pump, etc.). A float valve senses water level and opens and closes a high pressure valve to add water to the tank when the level falls. Generally, the float must move a few inches to actuate the valve and open it fully. As a result the water level set by the float valve varies in accordance with the float position, and accordingly fluctuates up and down by a factor of a few inches. This fluctuation may be acceptable in a standard pool, but in a vanishing edge pool this sort of ebb and flow repeatedly exposes the top edge of the pool wall and spoils the stunning visual effect of the vanishing edge pool.

BRIEF SUMMARY OF THE INVENTION

The present invention generally comprises a method and apparatus for automatically filling a pool and setting a fill level, and automatically draining a pool and setting a drain level to maintain the pool water level within a very small vertical range. The invention is particularly adapted for use with vanishing edge pools, but may be used with a wide variety of pool arrangements.

In one aspect the invention includes a first tank having a first water level, the first tank including a first float valve connected to a high pressure water source. The float valve regulates the first water level to within a few inches of a nominal desired level. The invention also includes a second tank having a second water level that is below the first water level, thereby defining a pressure head between the two tanks that is in the range of a few inches to a foot. The second tank includes a second float valve that is supplied by the pressure head between the two tanks, so that the second float valve receives low pressure water and is adapted to open and close within a range that spans a fraction of an inch.

The second tank also includes a drain opening that is placed at a vertical position that is very close to the water fill level that is set by the second float valve. The drain opening is connected to a sewer line or the like. The second tank water level may fluctuate only between an upper limit set by the drain opening and a lower limit set by the opened position of the second float valve. The second tank is connected directly to the pool in open flow communication, so that the water level set in the second tank in turn sets the water level of the pool. Thus the pool water level is very precisely regulated by the apparatus of the invention.

In a further aspect of the invention, the drain opening and the second float valve are mounted on a common structure, so that the upper and lower limits of the second tank water level are maintained in a closely spaced relationship. Furthermore, the common structure may be supported on a vertically adjustable assembly so that the second tank water level may be adjusted as required to maintain the proper pool water level.

In another aspect of the invention, the first tank may be disposed within the confines of the outer wall of the second tank. In addition, a flexible pipe extends from the first tank to the second float valve so that the pressure head of the first tank is delivered to the second float valve. The second float valve processes very low pressure water, and is thus capable of regulating the water level to a fraction of an inch.

DETAILED DESCRIPTION OF THE INVENTION

Figure 1:
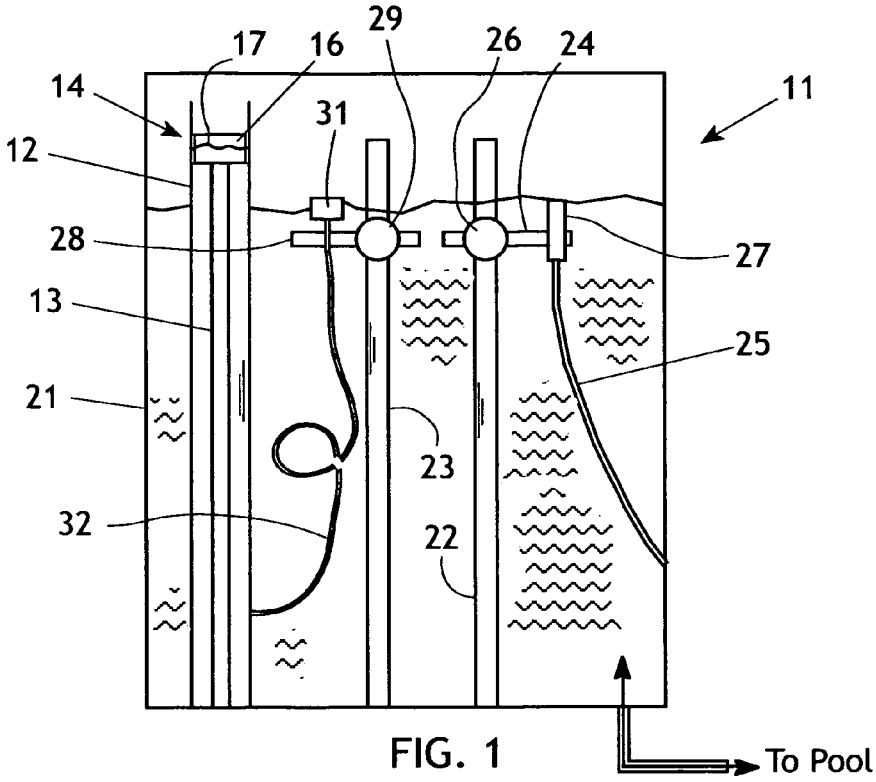
FIG. 1 is a schematic view of the general aspects of the pool water level control apparatus of the present invention.

The present invention generally comprises a method and apparatus for automatically filling a pool and setting a fill level, and automatically draining a pool and setting a drain level to maintain the pool water level within a very small vertical range. With regard to FIG. 1, the apparatus 11 of the invention includes a first water tank 12 having a supply pipe 13 extending therein and connected to a high pressure source of water, such as a municipal water main, pump, or the like. A first float valve 14 is movably secured to the upper end of the supply pipe 13, and is configured in any manner known in the prior art to provide a float 16 connected to a high pressure water valve, such as a toilet-type float valve. The first float 16 establishes a first water level 17 in the tank 12.

The invention also includes a second water tank 21 that is provided with a pair of vertical support rods 22 and 23. A first support arm 24 is joined to rod 22 by a first vertically adjustable support member or thumbscrew-type clamp 26 which is vertically adjustable along the rod 22. A drain fitting 27 is carried by arm 24, and is connected to means for connecting, i.e. a flexible drain pipe 25 that provides sufficient slack for vertical adjustment of the position of the drain fitting 27. Thus the upper limit of the range for the water level may be set by selectively positioning the drain fitting 27. A second support arm 28 is joined to rod 23 by a second vertically adjustable support member or thumbscrew-type clamp 29 which is vertically adjustable along the rod 23. A second float valve 31 is supported on arm 28, and is connected through means of supplying, i.e. a flexible pipe 32 to join the first tank below the water level thereof, whereby low pressure water from tank 12 is supplied to float valve 31. The float valve 31 may be any form of low pressure valve known in the prior art or described more specifically below. The level at which the float valve 31 switches open comprises the lower limit of the range for the second water level, and may be set by selective positioning of the support arm 28. The second tank 21 is connected directly to the pool in open flow communication, so that the water level (the second water level) set in the second tank 21 in turn determines the water level of the pool. Thus the pool water level is very precisely regulated by the apparatus of the invention. It may be appreciated that when float valve 31 is open, it is gradually draining tank 12. This condition will cause float valve 14 to cycle ON more frequently to resupply tank 12.

The first tank 12 may be disposed within the second tank 21 for the convenience of a compact assembly, and the ability to catch within the outer tank any overflow or leak emanating from the inner tank. However, it is evident that the first tank may be located at any convenient spot outside the second tank, if so desired.

Figure 2:
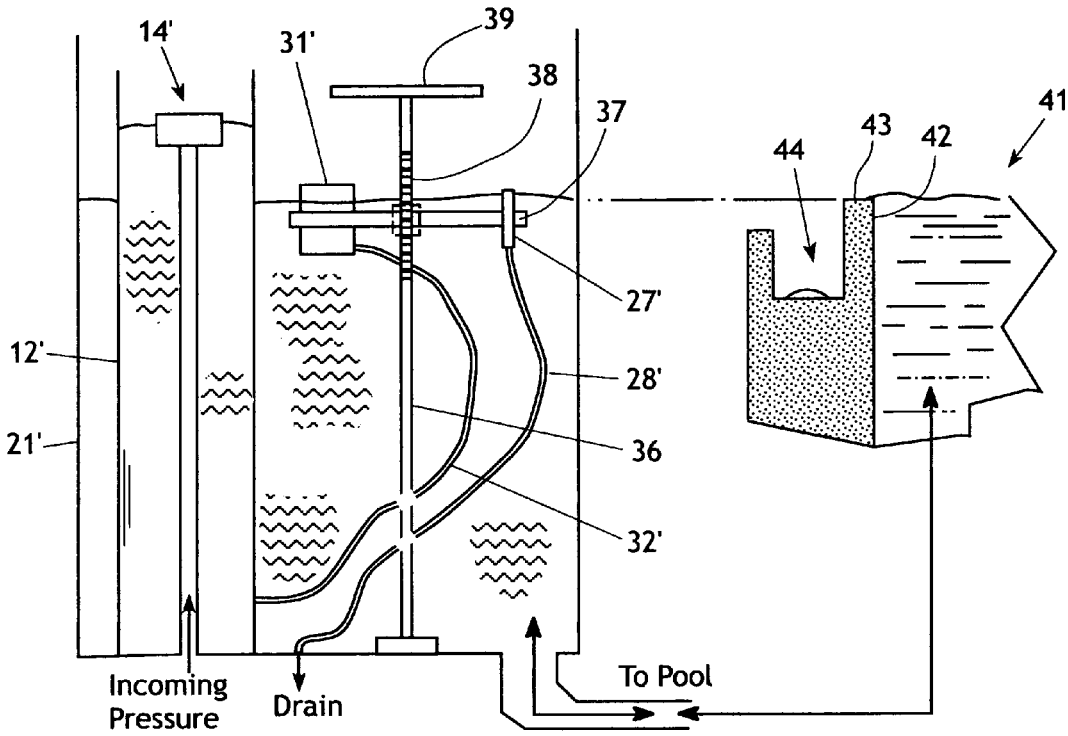
FIG. 2 is a schematic view of a further embodiment of the pool water level control apparatus as applied to a vanishing edge pool.
Figure 3:
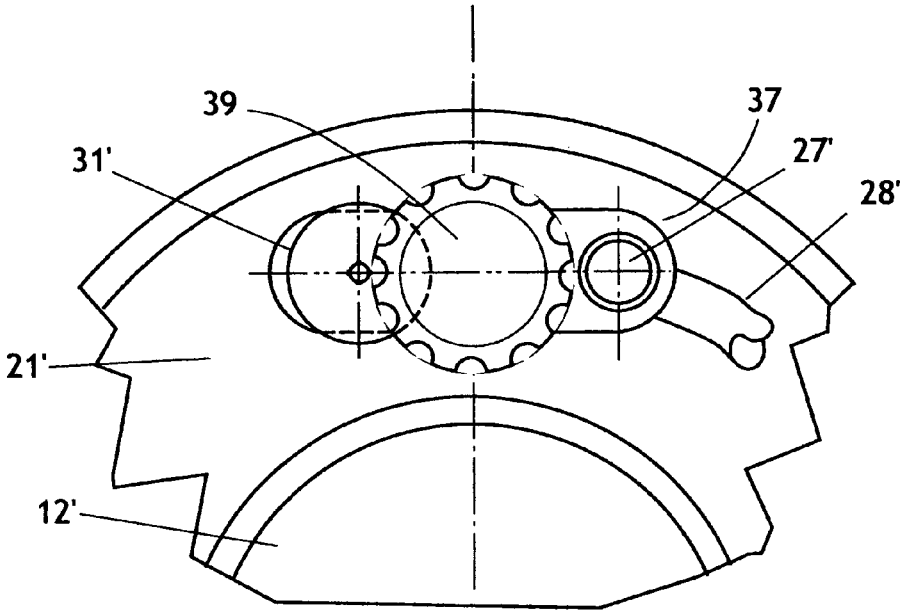
FIG. 3 is an enlarged top view of another embodiment of the pool water level control apparatus of the invention.

With regard to FIGS. 2 and 3, an improved embodiment of the invention is depicted, with components common to the embodiment of FIG. 1 denoted with the same reference numeral with a prime (') designation. The first tank 12' with float valve 14' is disposed within second tank 21', and tank 12' is supplied with high pressure water. The second tank 21' is in direct flow communication with the pool, so that the level set in tank 21' determines the pool water level. A support rod 36 extends vertically in tank 21', and supports a cross arm 37. The low pressure float valve 31' is supported on one end of the cross arm 37, and the drain fitting 27' is supported on the other end of the cross arm 37. Float valve 31' is connected through flexible hose 32' to receive a low pressure water supply from tank 12'. Drain fitting 27' is connected through flexible hose 28' to an external drain. Drain fitting 27' may be provided with a telescoping intake end or the like to enable a slight adjustment of the drain opening height with respect to the support arm 37.

As described previously, the second tank water level may fluctuate only between an upper limit set by the opening of drain 27 and a lower limit set by the opened position of the second float valve 31'. In the embodiment of FIGS. 2 and 3, the devices that set these two limits are supported by a common structure, so that these limit levels may be maintained within very close spacing relative to each other. The support rod 36 may have a threaded portion 38, and the cross arm may be threaded in complementary fashion engage the rod 36. The rod 36 may be provided with a handle 39 at the upper end thereof, whereby the rod 36 may be rotated to move the cross arm 37 vertically in its threaded engagement. Thus the water level limits are held in their relative spacing, and may be moved in concert to set the pool level.

For example, a vanishing edge pool 41 may have a pool wall 42 with an upper edge 43 extending for at least a portion of the pool perimeter. A drain channel 44 is provided at the outside surface of the pool wall and disposed beneath the upper edge 43, whereby the pool edge gives the appearance of brimming over with water. The handle 39 may be rotated to move the cross arm 37 vertically so that the upper and lower limits set by the devices 27' and 31' closely bracket the level of the pool edge 43. Thus the proper fill level may be maintained without wasting water or diminishing the full, brimming appearance of the pool.

Figure 4:
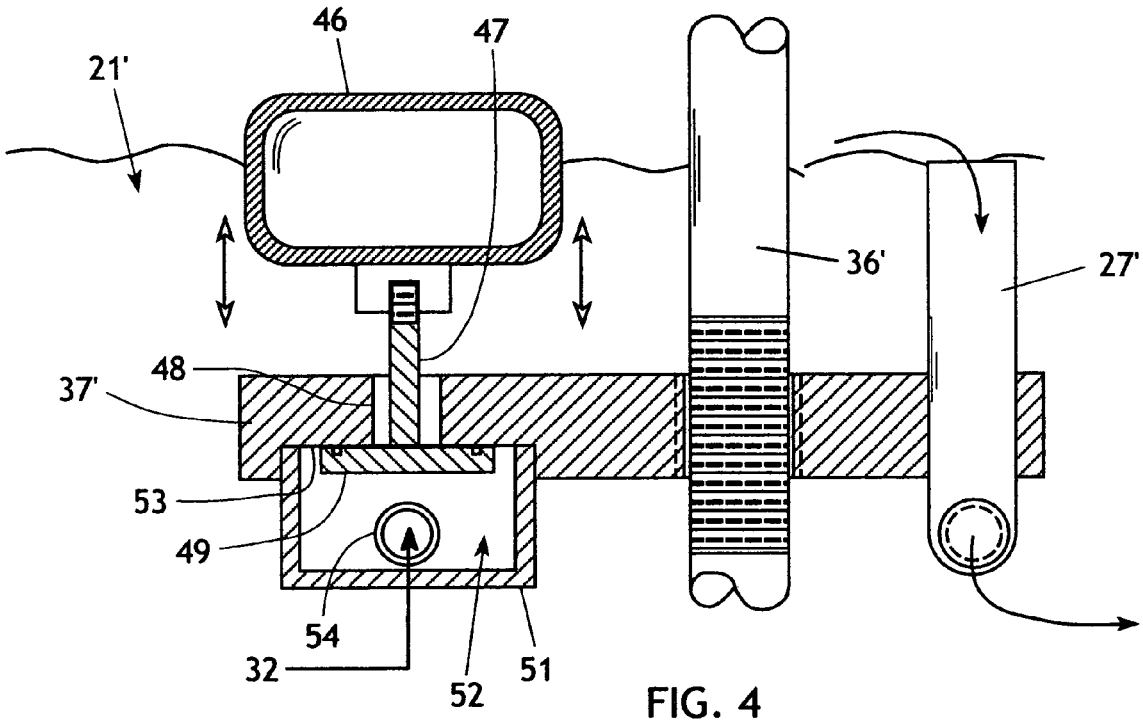
FIG. 4 is an enlarged cross-sectional elevation of another embodiment of the pool water level control apparatus of the invention.

With regard to FIG. 4, a more detailed embodiment of the invention is depicted, with components common to the embodiments of FIGS. 1 and 2 denoted with the same reference numeral with a prime (') designation. The cross arm 37' is supported on a threaded portion of vertical rod 36', as described previously. And the drain fitting 27' is supported at one end of the cross arm 37', as before. The low pressure float valve 31' is comprised of a float 46 having a shaft 47 extending downwardly therefrom along a central axis of the float 46. The shaft 47 extends in freely translating fashion through an opening 48 in the cross arm 37' and is joined at its lower end to valve plate 49. A valve housing 51 surrounds the valve plate 49 and defines a closed valve chamber 52 together with the valve plate 49 seated against an inner surface 53 of the chamber 52 surrounding the opening 48. An inlet 54 is connected to the flexible hose 32 to supply low pressure water from tank 12'.

It may be appreciated that the weight of the float and shaft assembly tends to push the shaft downwardly and open the flow path that is sealed by valve plate 49 and inner surface 53. The weight is opposed by the buoyant force created by the immersion of the float in the water within tank 21', as well as the higher water pressure inside the valve chamber 52. The amount of immersion of the float 46 determines the buoyant force, and the water level that causes a balance between the float weight and buoyancy comprises the level set by the float valve 31' The level at which the float valve 31' switches open comprises the lower limit of the range for the water level in tank 21', and may be set by selective positioning of the cross arm 37'. Due to the fact that the float valve arrangement of FIG. 4 is dealing with a low pressure water supply, the seal of valve parts 49 and 53 need not be tight nor forceful, so that only a small change in float buoyancy is required to open or close the flow path. Thus the valve 31' is able to open and close within a range of motion of a small fraction of an inch.

Figure 5:
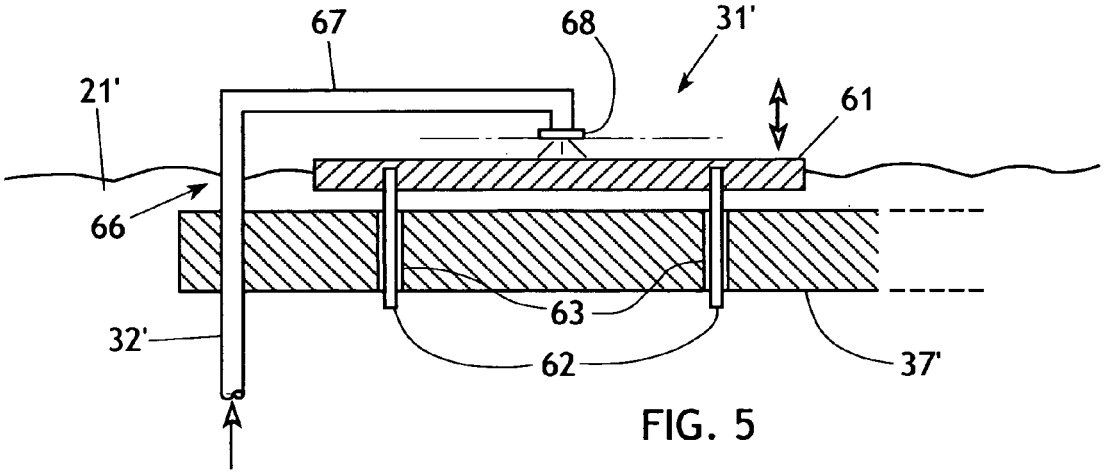
FIG. 5 is an enlarged cross-sectional elevation of a further embodiment of the low pressure float valve of the invention.

With regard to FIG. 5, another embodiment of the float valve 31' of the invention is depicted, with components common to the embodiments of FIGS. 1-3 denoted with the same reference numeral with a prime (') designation. A disk-like float 61 extends laterally above one end of the cross arm 37', and a plurality of float guide pins 62 extend downwardly from the float 61 and through complementary guide holes 63 in the cross arm 37'. The disk may be formed of a buoyant plastic material such as expanded or foamed polymer that has high strength and low density. A valve head 66 extends upwardly from the cross arm 37', and is connected to flexible supply hose 32'. Valve head 66 includes a laterally extending portion 67 that traverses outwardly to the disk float 61. The distal head 68 of the valve head is angled to direct a stream of water onto the central area of the upper surface of disk float 61, thereby adding water to tank 21' and gradually filling it. When the water level rises sufficiently to impinge the upper surface of the disk float on the distal head 68, it blocks the low pressure flow from the head 68 and stops the water input to tank 21'. When the level falls slightly (on the order of a fraction of an inch) the outflow from the valve head 68 is restarted. Thus the lower limit to the water level is substantially coplanar with the output surface of the valve head 68.

It may be appreciated that the invention utilizes no electrical components and thus eliminates the costs and risks of an electrical power connection. Moreover, the invention may be assembled and sold at a reasonable cost to any pool owner or operator. The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. A water level control apparatus located adjacent to a pool, said water level control apparatus comprising:

a first tank having a first water level;

a second tank having a second water level below said first water level, and a pressure head in said first tank equal to the difference between said first and second water levels, wherein said second tank connected directly to the pool for free water flow therebetween so that the second water level in said second tank determines the water level in the pool;

a first float valve in said first tank for setting said first water level;

a second float valve in said second tank for setting a lower limit for the range of said second water level;

means for supplying said second float valve with the pressure head from said first tank, whereby low pressure water is fed to said second float valve from said first tank, said second float valve opening and closing within a narrow vertical range to precisely control said lower limit for the range of said second water level;

an overflow drain fitting supported in said second tank, said overflow drain fitting having an opening that sets an upper limit for the range of said second water level, and means for connecting said overflow drain fitting to an external drain outside of said second tank, said overflow drain fitting is connected to a first vertical support rod via a first support arm disposed in said second tank, and said overflow drain fitting is adjusted vertically via a first vertically adjustable support member slidably mounted on said first vertical support rod; and means for vertical adjustment of the position of said second float valve to selectively vary said lower limit of said range of said second water level, wherein said means for vertical adjustment includes a second support arm and a second vertically adjustable support member disposed in said second tank, said support arm supported said second float valve, and said second float valve is adjusted vertically via said second vertically adjustable support member that slidably mounted on a second vertical support rod.

2. The water level control apparatus for a pool of claim 1, further including an overflow drain fitting supported in said second tank, said drain fitting having an opening that sets an upper limit for the range of said second water level, said overflow drain fitting being supported on said cross arm, whereby said upper and lower limits of said range of said second water level are adjustable simultaneously by selectively varying the vertical position of said cross arm.

3. The water level control apparatus for a pool of claim 1, further including an overflow drain fitting supported in said second tank, said drain fitting having an opening that sets an upper limit for the range of said second water level, said overflow drain fitting being disposed at a vertical position that is separately adjustable with respect to said second float valve.

4. The water level control apparatus for a pool of claim 1, wherein said first tank in disposed with the confines of said second tank.

5. The water level control apparatus for a pool of claim 1, wherein said overflow drain fitting includes a telescoping inlet section for selective adjustment of the vertical position of said opening.

6. A water level control apparatus located adjacent to a pool, said water level control apparatus comprising:

a first tank having a first water level, a first float valve in said first tank for setting said first water level; wherein said first float valve is a high pressure float valve disposed in said first tank to receive high pressure water and establish said first water level;

a second tank having a second water level; wherein said first water level being maintained above said second water level to develop a low pressure head between said first and second tanks;

said second tank connected directly to the pool for free water flow therebetween, whereby said second water level in said second tank sets the pool water level;

a second float valve in said second tank for setting a lower limit for the range of said second water level, wherein said second float valve is a low pressure float valve;

means for supplying said low pressure float valve with said low pressure head from said first tank, whereby low pressure water is fed to said low pressure float valve from said first tank, wherein said low pressure float valve operates with low pressure water to open and close within a narrow vertical range to precisely control said lower limit for the range of said second water level;

an overflow drain fitting supported in said second tank, said overflow drain fitting having an opening that sets an upper limit for the range of said second water level, and means for connecting said overflow drain fitting to an external drain outside of said second tank, said overflow drain fitting is connected to a first vertical support rod via a first support arm disposed in said second tank, and said overflow drain fitting is adjusted vertically via a first vertically adjustable support member slidably mounted on said first vertical support rod; and means for vertical adjustment of the position of said low pressure float valve to selectively vary said lower limit of said range of said second water level, wherein said means for vertical adjustment includes a second support arm and a second vertically adjustable support member disposed in said second tank, said support arm supported said low pressure float valve, and said low pressure float valve is adjusted vertically via said second vertically adjustable support member that slidably mounted on a second vertical support rod.

7. The water level control apparatus for a pool of claim 6, wherein said overflow drain fitting and said low pressure float valve means are adjustable simultaneously while maintaining a fixed spacing between said upper and lower limits for said second water level.

8. The water level control apparatus for a pool of claim 6, wherein said low pressure float valve means includes a buoyant disk supported for vertical movement within said second tank, a valve head connected to said low pressure head and having an output end disposed to discharge water toward a central portion of said buoyant disk, said disk blocking discharge from said valve head when said disk impinges buoyantly on said output end of said valve head.

9. The water level control apparatus for a pool of claim 6, wherein said first tank is disposed within the confines of said second tank.

* * * * *